US005651168A

United States Patent [19]

Tung et al.

[11] Patent Number: 5,651,168

[45] Date of Patent: Jul. 29, 1997

[54] ABRASION RESISTANT CHENILLE YARN AND FABRIC AND METHOD FOR ITS MANUFACTURE

[75] Inventors: Peter Tung, Bristol; Duncan Whitehead, Barrington, both of R.I.

[73] Assignee: Quaker Fabric Corporation of Fall River, Fall River, Mass.

[21] Appl. No.: 457,757

[22] Filed: Jun. 1, 1995

[51] Int. Cl.[6] ..... D03D 27/18; D02G 3/42

[52] U.S. Cl. ..... 28/220; 28/144; 57/24

[58] Field of Search ..... 28/144, 220; 57/24, 57/203, 236, 238, 239, 309

[56] References Cited

U.S. PATENT DOCUMENTS

| | | | |
|---|---|---|---|
| 2,575,753 | 11/1951 | Foster | 28/144 X |
| 3,715,878 | 2/1973 | Kim | 57/156 |
| 3,869,850 | 3/1975 | Gross | 57/24 |
| 3,969,881 | 7/1976 | Boldrini | 57/24 |
| 4,490,995 | 1/1985 | Schmidt | 66/191 |
| 4,517,715 | 5/1985 | Yoshida et al. | 28/144 |
| 4,668,552 | 5/1987 | Scott | 428/92 |
| 5,009,946 | 4/1991 | Hatomoto et al. | 428/87 |
| 5,178,630 | 1/1993 | Schmitt | 623/1 |
| 5,259,178 | 11/1993 | Sostegni | 57/24 |

FOREIGN PATENT DOCUMENTS

| | | | |
|---|---|---|---|
| 3445138 | 6/1986 | Germany | 57/24 |
| 1321937 | 12/1989 | Japan | 57/24 |
| 2014035 | 1/1990 | Japan | 57/24 |
| 4333633 | 11/1992 | Japan | 57/24 |

*Primary Examiner*—John J. Calvert

*Attorney, Agent, or Firm*—Gottlieb, Rackman & Reisman, P.C.

[57] ABSTRACT

A method is disclosed for the manufacture of a novel chenille upholstery fabric and chenille decorative throw. The chenille yarn contains a continuous filament binder yarn comprising a polymer selected to have a melting point which allows melting to occur at maximum speeds either in a tenter frame or in a heat setting machine. The chenille yarn comprises a pile, a core and the continuous filament binder yarn. The chenille fabric is woven from the chenille yarn and the binder yarn is melted to bind the pile to the core. In one embodiment the melting occurs in a tenter frame during the curing of a latex backing for the fabric. In a second embodiment, the melting occurs in a heat setting machine prior to weaving. As part of both embodiments, the core is air textured together with the binder yarn.

8 Claims, 6 Drawing Sheets

ABRASION RESISTANT CHENILLE YARN AND FABRIC AND METHOD FOR ITS MANUFACTURE

BACKGROUND OF THE INVENTION

The present invention concerns chenille yarns that have significantly improved abrasion resistance and lower pile loss characteristics and methods for their production. In particular, the invention concerns chenille yarn in which the effect fibers are fused to a retaining core using bonding filament yarns manufactured from such polymers as ethylene-octene copolymer, quad nylon polymer and nylon 11 polymer and other low melting point binding yarns. Among the uses for the improved chenille are residential upholstery fabrics, decorative throws, contract (office furnishings) fabrics and automotive fabrics. The invention further covers a low cost chenille upholstery fabric having superior abrasion resistance properties and the method for its production. In particular the invention concerns a method for economically manufacturing such a fabric using conventional chenille manufacturing machines and a standard latex tenter frame apparatus. It also covers a method that produces the higher abrasion resistant chenille using a standard heat setting machine.

Chenille upholstery fabric is formed by weaving chenille yarn into the fabric. The chenille yarn is first formed on a yarn manufacturing device that twists together two basic components. The first component of the yarn is a core component comprised of two or more continuous yarns twisted together. This first component provides strength to the resulting chenille yarn. It also retains the second component, called the pile, which consists of discontinuous cut fibers. The pile fibers are gripped between and protrude transversely all around the core yarns.

The pile fibers are normally held in place mechanically by friction. This construction results in a certain amount of pile loss during normal consumer use of the fabric formed from the chenille yarn due to this inherent design. Such pile loss causes restrictions in the use of fabrics that can be designed with the normal chenille yarns. These restrictions for flat woven fabrics include: being able to design open soft residential fabrics, the design of contract and automotive fabrics, the design of decorative throws whose fringes will not lose the pile on the chenille in use. For example, these restrictions impose a limit on the extensive use of chenille in upholstery fabrics, since such fabrics are necessarily subject to friction resulting in the unsightly removal of pile. Thus prior to the present invention chenille has not played a significant role in the fabrication of high quality upholstery fabrics.

U.S. Pat. No. 5,009,946 to Hatomoto et al. discloses an electrically conductive chenille yarn for automobile upholstery having fibers, which may comprise a synthetic polymer such as a polyester yarn coated with electrically conductive material and a separate holding yarn. (Col. 5, line 61) The resulting fabric has a conductive backing material made from carbon powder dispersed in a backing resin. The low-melting point polyester yarn is fused prior to weaving, to cause the pile to be equally spread around the core so that the electrically conductive yarn can come into better contact with the person sitting on the fabric to conduct away static.

U.S. Pat. No. 4,517,715 to Yoshida et al. discloses a chenille fabric having a smooth surface touch and a silk-like high-grade luster made by using synthetic fiber yarn with raised ultra-fine fibers, where the raised fibers are fused to the core yarns at a particular angle. The Yoshida patent employs multiple heating stages during the fabrication of its chenille fabric. For example, Yoshida et al. employs a steam setting stage prior to weaving to melt its low-melting-point polyamide yarn and temporarily bond the pile yarn to the core yarns. After weaving the fabric and further processing, the fabric is dry-heat-set in a pin tenter drier to completely bond the fibers to the core yarns.

BRIEF DESCRIPTION OF THE INVENTION

This invention improves the pile loss characteristic of current designs and allows the creation of a much wider variety of fabric designs. The invention allows chenille yarns to be used in contract and automotive fabrics that heretofore have had abrasion specifications that could not be met by current chenille yarns and allows high quality upholstery fabrics to be produced without latex backing.

To significantly improve pile fiber retention, chemical bonding between pile and core is necessary. This is achieved by incorporating particular low melt components into the core of the chenille either during the spinning step in a chenille machine, or previously by air texturing with the binder yarn. Where the incorporation takes place during spinning, these additional yarns are integrated into the core of the chenille yarn as it is twisted. When heat is subsequently applied to the chenille yarn, the low melting point polymer yarn loses its integrity as a fiber and becomes points of adhesion between the core and the pile.

The present invention concerns an improved chenille yarn that allows for significant improvements in the abrasion resistance of various types of upholstery fabric. In one embodiment the invention concerns an improved chenille upholstery fabric using filling yarns of olefin chenille and a latex backing.

Previous residential fabrics fashioned from the original chenille yarns have abrasion test results of 5000 double rubs (ASTM test 4157). 5000 double rubs is equal to about 3–4 years of use on furniture. The fabric of the present invention has an abrasion value of 15,000 double rubs. The resulting fabrics have superior abrasion characteristics to any known upholstery chenille fabrics similarly constructed with warp ends and picks and having a similar quantity of latex backing. It significantly reduces pile pull out for upholstery fabrics containing chenille.

Fabrics constructed of the new chenille type and using constructions suitable for contract and automotive fabrics have abrasions values of 40,000 double rubs.

High styled, more expensive residential upholstery fabrics are produced using rayon and cotton chenilles. In order to provide the fabrics with sufficient abrasion resistance, these fabrics receive a latex coating. This coating detracts from the beauty and softness of the fabrics. The new chenilles provide sufficient abrasion resistance (15,000 double rubs) in these fabrics without the need for a latex backing process.

Decorative throws are constructed by weaving a flat woven fabric and leaving a fringe of approximately six inches. The pile in the normal chenille yarn in the fringe comes out very quickly in use. The new chenille allows the pile to remain in the yarn in the fringe during prolonged use.

The present invention increases the bonding between the core and the pile component by introducing a bonding agent to provide a chemical adhesion between the core and the pile in addition to the physical adhesion achieved by twisting of the core and pile. The bonding agent is a bonding fiber melting below 130° C. to bind the chenille pile yarn to the core yarn. Various bonding yarns have been used. They are all multifilament yarns varying from 60 to 400 denier. All have melting points less than 130° C. The three basic types are a polyethylene (ethylene—octene copolymer), a quad polymer (nylon 6, nylon 66, amino 11 and 12), low melt nylon 11 and a copolyester.

The bonding yarn multifilament fiber has properties that enable its processing in conventional chenille manufacturing equipment, weaving, finishing and heat setting equipment. The type of bonding yarn selected is based on the fiber properties of the pile and core components and the melt flow characteristics to provide the optimum fusion between the core and pile components of the chenille. The objective is that when the bonding yarn melts it flows along and around the core yarns and across each of the ends of the pile yarn and upon setting then secures the pile to the core. Where a latex backing is employed for an olefin chenille fabric the bonding yarn is preferably a polyethylene that melts to flow across all the pile ends in the chenille yarn during the stage of curing the latex backing applied to the woven chenille fabric.

It is an object of the present invention to provide a method for the manufacture of a chenille upholstery fabric with increased abrasion resistance and using conventional manufacturing equipment to accomplish the method.

It is a further object of the present invention to provide methods for the manufacture of various types of chenille upholstery fabrics comprising the steps of providing to a chenille yarn forming machine a bonding fiber comprising one or more polymers selected to have melting points which allows melting to occur at maximum speeds in a tenter frame, forming on said machine a chenille yarn comprising a pile and a core of the continuous filament yarn, weaving a chenille fabric from said yarn, and curing a latex backing for the fabric in a tenter frame during which curing step the binder yarn is melted to bond the pile to the core of the chenille.

DETAILED DESCRIPTION OF A PREFERRED EMBODIMENT

A special polyethylene (a Dow Chemical ethylene-octene-copolymer 1147) is utilized that allows for a 1/250/52 polyethylene continuous multifilament yarn to be manufactured with the following properties and by the process described:

(a) extrudable on commercial fiber extrusion equipment, (b) strong enough after fiber drawing to process at the high speeds of electronic chenille manufacturing equipment, (c) meltable between 105° C. and 115° C., which enables latex wrung tenter frame speeds of 25–30 yards per minute, which is the highest speed that avoids plastifying the olefin component of the chenille yarn, (d) at the melting step, the polyethylene yarn melts in position and laminates, in the case of olefin chenille, to the olefin pile and polyester core, thereby locking the pile to the core, (e) stabilizer components of the polyethylene are designed without the use of phenolic components to avoid, in the case of olefin chenille, the yellowing of the light colors of the olefin pile yarns.

Figure 1:
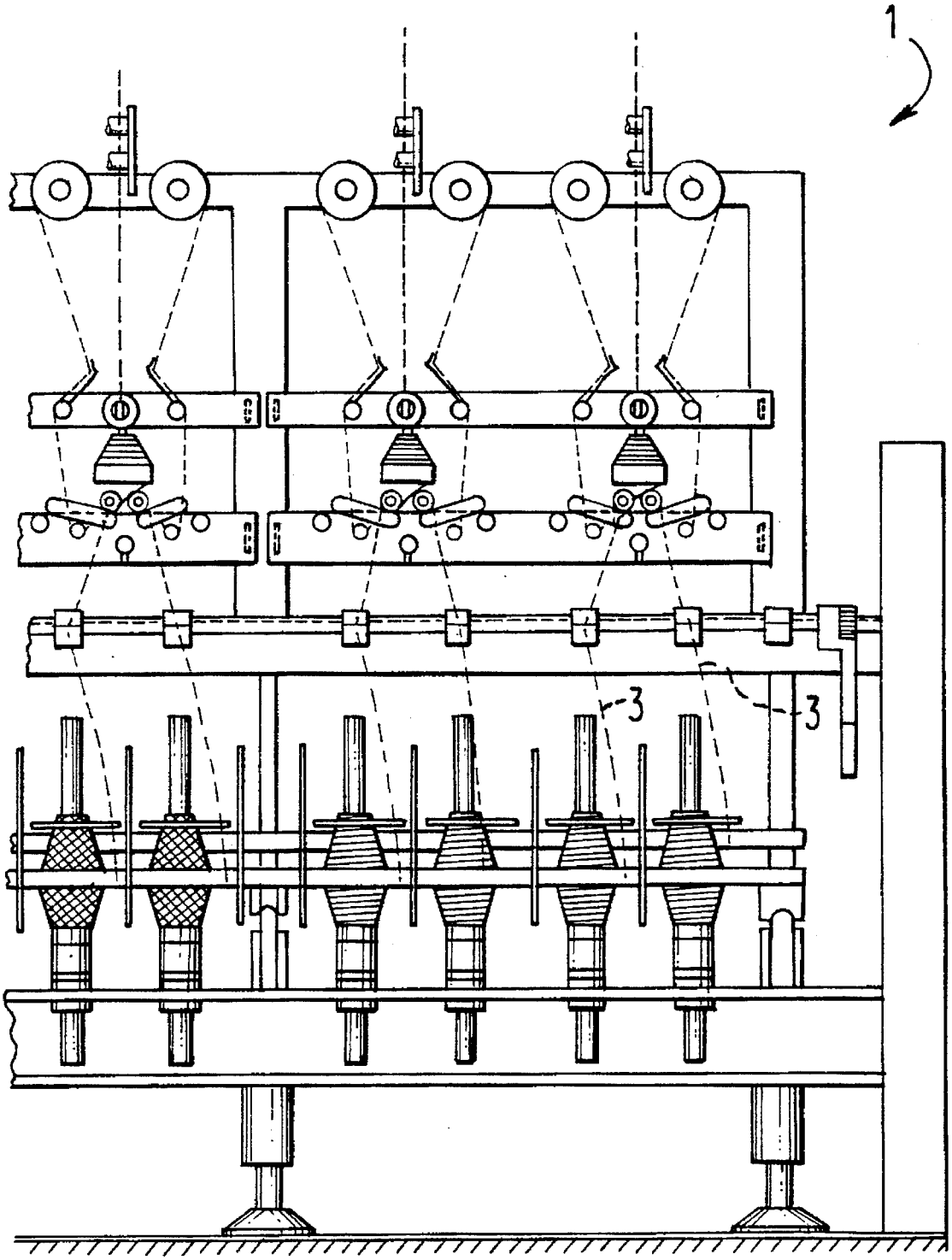
FIG. 1 depicts a chenille yarn producing machine for combining core and pile ends into a chenille yarn.
Figure 2:
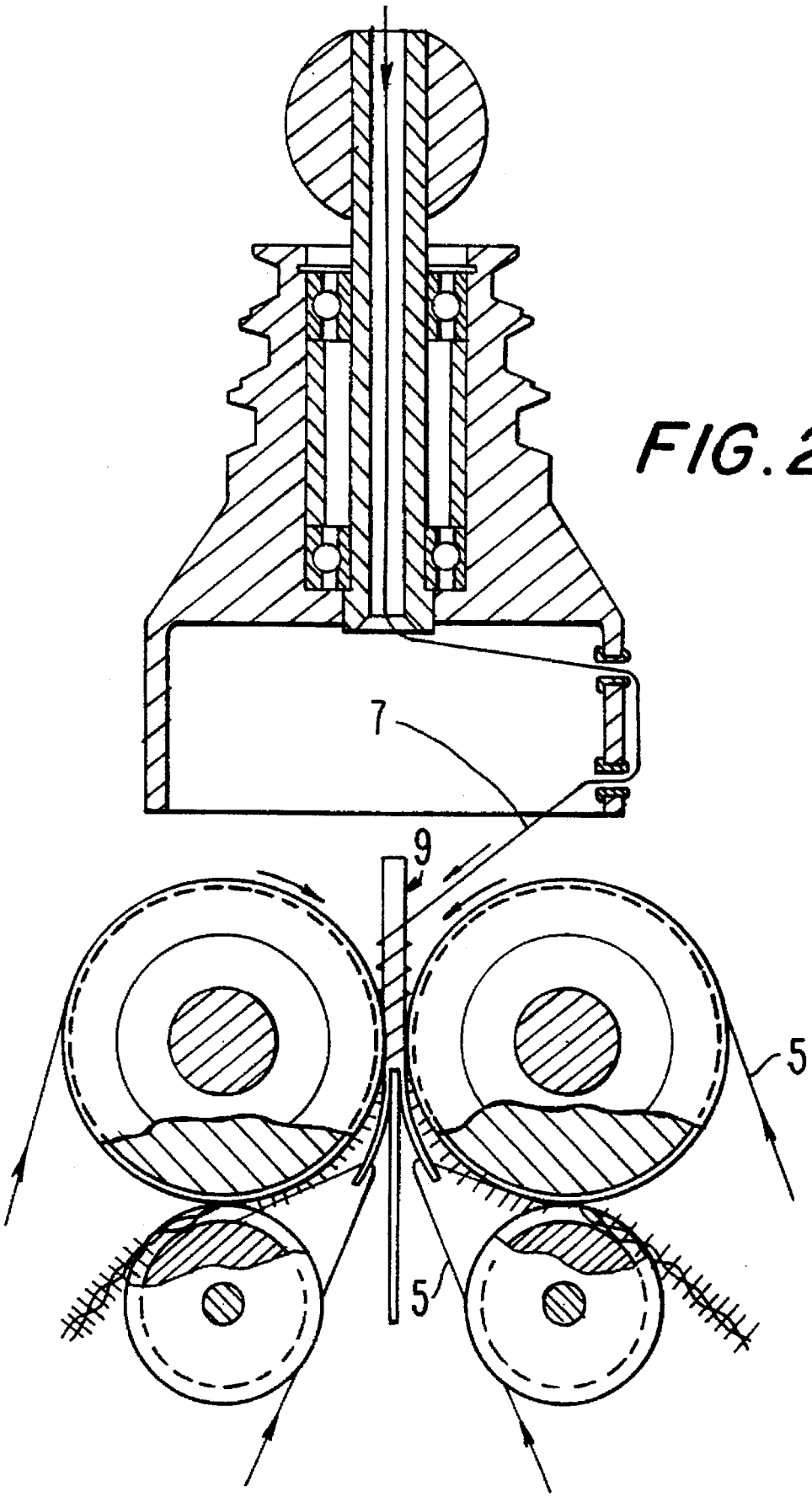
FIG. 2 depicts a portion of the chenille yarn producing machine of FIG. 1 showing the formation of a chenille yarn from two core ends and a pile end.
Figure 3:
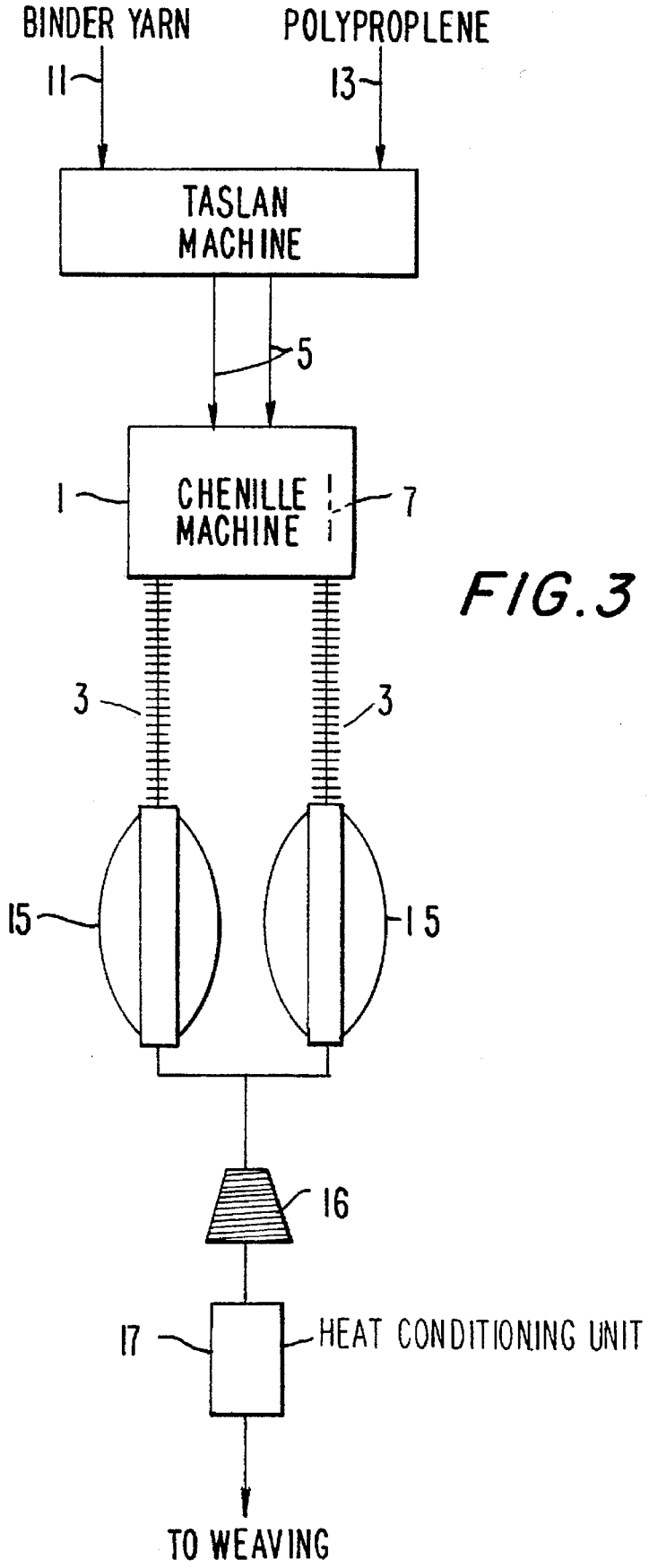
FIG. 3 is a schematic diagram of the process steps for the formation of a chenille yarn of the present invention.
Figure 4:
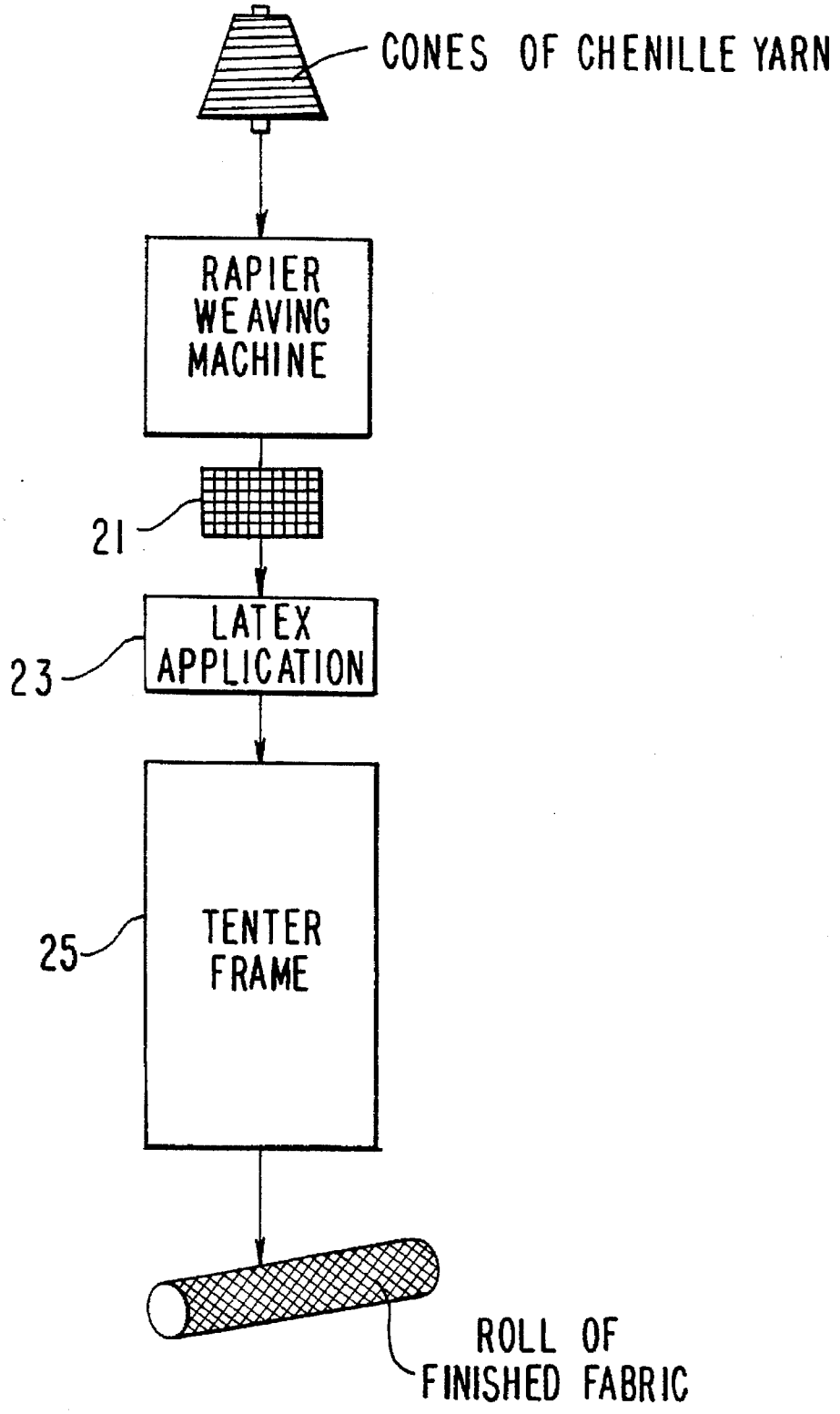
FIG. 4 is a schematic diagram of the process steps for the formation of a chenille fabric from the chenille yarn of the present invention.
Figure 5:
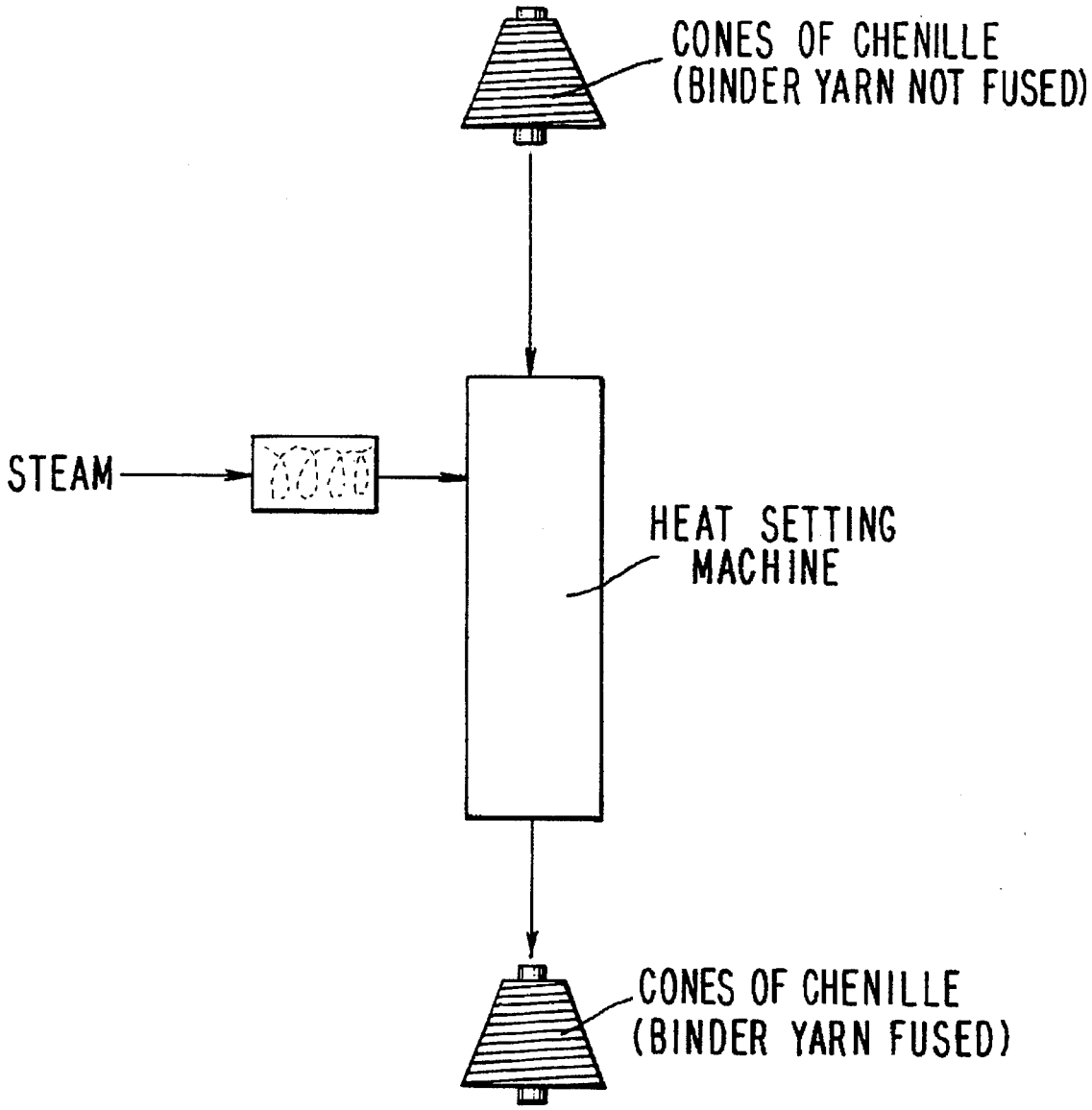
FIG. 5 is a schematic diagram of the process steps for the heat setting of the chenille yarn to activate the binder yarn.
Figure 6:
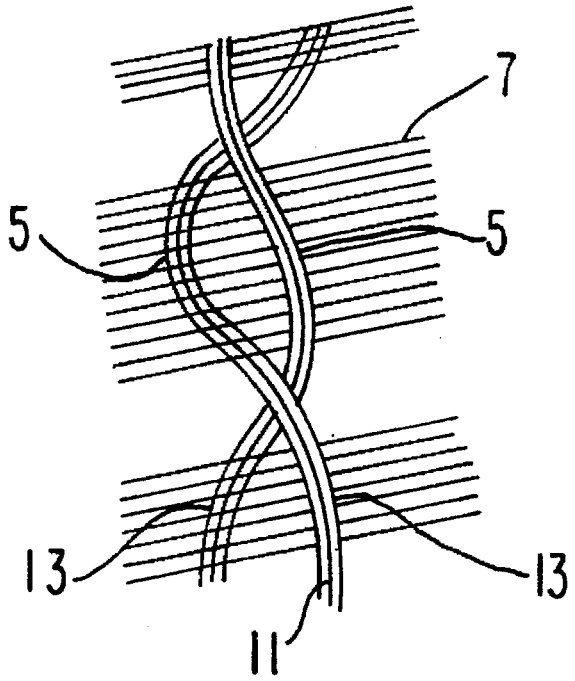
FIG. 6 is a diagram of a section of the yarn of the present invention prior to fusing. The air texturing of the core ends is shown schematically as a double strand.
Figure 7:
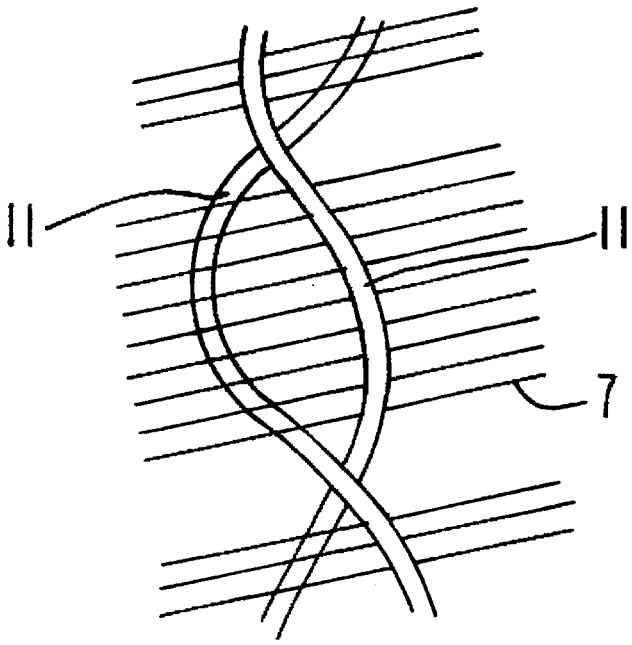
FIG. 7 is a diagram of a section of the yarn of the present invention after formed into a fabric and fused. The fused binder strand is shown as a series of small droplets adhering the effect strands.

As shown in FIG. 1, The chenille yarn is preferably fabricated on a machine 1 designed for producing pairs of chenille yarns 3, each formed by two binding yarns 5 (See FIG. 2) twisted together to bind short sheared lengths of a pile yarn 7, by twisting the binding threads together with the sheared lengths of the pile yarn engaged therebetween. The machine has forming units that include winding and sizing members 9 for the effect yarn. The pile yarn is wound on an associated winding and sizing member to form turns about a chenille former portion. The turns move downwardly as shown in FIG. 2 and a shearing blade shears the turns of pile yarn to form lengths which are engaged by the binding yarns that are twisted together to retain the pile yarn. The construction and operation of such a machine is described in detail in U.S. Pat. No. 3,969,881 to Boldrini.

In a preferred embodiment the 1/250 polyethylene binder yarn 11 is air textured (taslanised with one end of 210/144 polypropylene 13 to form a 500 denier taslan binder yarn). This process is carried out on a standard air texturing machine with air pressures of 150 psi and the yarn is run at a speed of 400 ypm. Two ends of the 500 denier polyethylene/polypropylene binder yarn are then used on the chenille machine for the core yarns 5. The pile yarns 7 are 300/144 polypropylene. A twist level of 12.5 twists per inch ("tpi") was used which still allows for a speed of 14.0 yards per minute ("ypm") to be used on the electronic chenille machine. The yarn is taken up on cops 15.

After the yarns have been wound on high speed (1000 ypm) winders onto dye cones 16 it is steam conditioned for 90 minutes in a heat conditioning unit 17 to stabilize the twist (atmospheric steam at 100° C.). This then results in a yarn that is weavable with high efficiency at high speeds (485 picks per minute) on Dornier rapier weaving machines 19. The temperature of the steam is not such as to cause the fusion of the low melt polyethylene yarn.

For finishing, the fabrics 21 are passed through a latex application unit 23 to receive an air foamed latex finish. The fabrics continue into a tenter frame 25 to cure the latex. The tenter frame is set for an air temperature of 145° C. During this finishing process the polyethylene component of the chenille core yarn melts and bonds the pile of chenille to the core. For the same total cost of manufacture of the fabric the resulting fabric has a threefold improvement in its abrasion resistance, thereby offering superior performance to the resulting furniture consumer.

The following are Examples of the process of the present invention.

1. Polypropylene chenille upholstery fabric (a) One end of 210 denier polypropylene is air textured together with one end of Hercules type T780 250 denier polyethylene (ethylene-octene copolymer) in a Taslan machine.

(b) Two ends of the resulting air textured yarn are used to form the core of an olefin chenille yarn to be combined with pile yarns of 300 denier olefin. This is then heat conditioned. The resulting yarn has a yarn size of 1200 yards per pound. Other denier values are in the range 60–400 denier in the polyethylene, and 200–1000 denier in the olefin are acceptable provided that the resulting yarn size is in the range of 500–3000 yards per pound.

(c) The fabric is then woven in a Rapier weaving machine, latexed and the latex fabric backing is dry heat cured at normal drier speeds and temperatures.

2. Acrylic chenille upholstery fabric (a) The chenille process uses a core of two ends of 20/1 spun, warp twist, polyester together with one end of 1/150 quad-polymer nylon binder yarn, and multiple ends of a 20/1 spun acrylic pile yarn. The resulting yarn has a yarn size of 1500 yards per pound. Other denier values in the range of 60–400 denier in the quad polymer nylon and 6/1 to 30/1 in the spun acrylic yarn. The notation 6/1 is cotton count nomenclature referring to 840×6 yards per pound of a singles yarn. The resulting acceptable yarn sizes are 500–3000 yards per pound.

(b) As in Example 1, the weaving, latexing and dry heat curing of the latex fabric backing takes place at normal drier speeds and temperatures.

In this notation 1/150 refers to a singles yarn of 150 denier.

3. Nylon chenille contract fabric (a) The chenille process uses a core of two ends of 24/1 spun warp twist nylon together with two ends of 75 denier nylon 11 binder yarn and a pile yarn of 20/1 spun nylon. The resulting yarn has a yarn size of 2000 yards per pound. Other acceptable denier values are the same as in example 2.

(b) Weaving latexing and dry heat curing the latex fabric backing takes place at normal drier speeds and temperatures.

4. Polyester chenille automotive fabric (a) The chenille process uses a core of two ends of 1/100 textured stretch polyester together with two ends of 75 denier nylon 11 binder yarn and a pile yarn of 150 denier polyester. The resulting yarn has a yarn size of 2500 yards per pound.

(b) Weaving, latexing and dry heat curing the latex fabric backing takes place at normal drier speeds and temperatures.

(c) Another end use process is to knit the resulting yarn on a 3 dimensional knitting machine that knits in one complete piece an automobile seat cover that subsequently is heat treated to activate the binder yarn.

5. Unbacked cotton upholstery fabrics (a) The chenille process uses a core of two ends of 30/2 and two ends of 75 denier polyethylene binder yarn and a pile yarn of 18/1 spun cotton.

(b) The yarn is heat set at 130° C. by feeding the yarn in a relaxed state into a heat setting machine. The resulting yarn has a yarn size of 1450 yards per pound.

(c) The fabric is woven and is suitable for direct use for residential upholstery applications.

6. Unbacked rayon upholstery fabrics (a) The chenille process uses a core of two ends of 16/1 high wet modulus rayon together with two ends of 75/20 polyethylene binder yarn and a pile yarn of 20/1 spun rayon.

(b) The yarn is heat set at 130° C. by feeding the yarn in a relaxed state into a heat setting machine. The resulting yarn has a yarn size of 2000 yards per pound.

(c) The fabric is woven and is suitable for direct use for residential upholstery applications.

In each of examples 4–16, other acceptable denier values are the same as in example 2.

7. Decorative throws, that use a heavy rayon chenille (a) The chenille process uses two ends of 1/250 polyethylene together with two ends of 12/1 HWM rayon and a pile yarn of 12/1 spun rayon. The resulting yarn has a yarn size of 360 yards per pound.

(b) The yarn is heat set at 150° C. by feeding the yarn in a relaxed state into a heat setting machine.

(c) The yarn is then woven into a decorative throw. Other denier values in the range of 60–400 denier in the binder yarn and 4/1 to 16/1 in the pile yarn are acceptable provided that the resulting yarn size is in the range of 200–1500 yards per pound.

8. Decorative throws, that use a heavy cotton chenille (a) The chenille process uses two ends of 1/250 polyethylene together with two ends of 8/1 spun cotton and a pile yarn of 12/1 spun cotton. The resulting yarn has a yarn size of 300 yards per pound.

(b) The yarn is heat set at 150° C. by feeding the yarn in a relaxed state into a heat setting machine.

(c) The yarn is then woven into a decorative throw.

In each of examples 4–8 other acceptable denier values are the same as in example 2.

The foregoing invention has been described in terms of a preferred embodiment. It should however be understood that the disclosed embodiment is merely exemplary of the present invention and the details of that embodiment should not be construed to limit the scope of the invention which is described in the following claims and their equivalents.

We claim:

1. A method for the manufacture of a chenille yarn comprising the steps of (a) Air texturing a binder yarn of taslan consisting of one end each of polyethylene and polypropylene with a filament yarn to form a taslanized binder yarn, (b) Combining the air textured binder yarn with a pile yarn of polypropylene in a chenille machine to form a chenille yarn, (c) Heat conditioning said chenille yarn below a temperature at which said binder yarn melts, to stabilize the twist, wherein the yarn size is between 500 to 3000 yards per pound.

2. A method for the manufacture of a chenille yarn comprising the steps of (a) Air texturing a binder yarn of quad-polymer nylon with a filament yarn to form a taslanized binder yarn, (b) Combining the air textured binder yarn with a pile yarn of a spun acrylic yarn in a chenille machine to form a chenille yarn, (c) Heat conditioning said chenille yarn below a temperature at which said binder yarn melts, to stabilize the twist, wherein the yarn size is between 500 to 3000 yards per pound.

3. A method for the manufacture of a chenille yarn comprising the steps of (a) Air texturing a binder yarn of nylon with a filament yarn to form a taslanized binder yarn, (b) Combining the air textured binder yarn with a pile yarn of a spun nylon yarn in a chenille machine to form a chenille yarn, (c) Heat conditioning said chenille yarn below a temperature at which said binder yarn melts, to stabilize the twist, wherein the yarn size is between 500 to 3000 yards per pound.

4. A method for the manufacture of a chenille yarn comprising the steps of (a) Air texturing a binder yarn of nylon 11 with a filament yarn to form a taslanized binder yarn, (b) Combining the air textured binder yarn with a pile yarn of a continuous filament textured polyester in a chenille machine to form a chenille yarn, (c) Heat conditioning said chenille yarn below a temperature at which said binder yarn melts, to stabilize the twist, wherein the yarn size is between 500 to 3000 yards per pound.

5. A method for the manufacture of a chenille yarn comprising the steps of (a) Combining a plurality of core yarns and binder yarns of taslan consisting of one end each of polyethylene and polypropylene in a chenille machine in combination with a pile yarn of polypropylene to form a chenille yarn, (b) Heat conditioning said chenille yarn below a temperature at which said binder yarn melts, to stabilize the twist, wherein the final yarn size is between 500 to 3000 yards per pound.

6. A method for the manufacture of an abrasion resistant chenille upholstery fabric comprising (a) using a chenille yarn manufactured by the method of anyone of claims 1–5 that uses a bonding fiber made from a polymer selected to have a melting point which allows melting to occur at maximum speeds in a tenter frame, (b) weaving a chenille fabric from said yarn, (c) curing a latex backing for the fabric in a tenter frame during which curing step the binder yarn is melted to bond the pile to the core of the chenille.

7. A method for the manufacture of an abrasion resistant chenille upholstery fabric comprising (a) using a chenille yarn manufactured by the method of anyone of claims 1–5 that uses a bonding fiber made from a polymer selected to have a melting point which allows melting to occur at maximum speeds in a tenter frame, (b) weaving a chenille fabric from said yarn, (c) processing said fabric in a tenter frame at a temperature sufficient to melt the binder yarn.

8. A method for the manufacture of a chenille yarn comprising the steps of (a) Air texturing a low melting point binder yarn, (b) Combining the air textured binder yarn with a pile yarn chosen from the pile yarns anyone of claims 1–4, (c) Heat conditioning said chenille yarn below the temperature at which said binder yarn melts, to stabilize the twist.

* * * * *